United States Patent [19]

Rodibaugh et al.

[11] 4,355,964

[45] Oct. 26, 1982

[54] GEAR PUMP HAVING FLUID DEAERATION CAPABILITY

[75] Inventors: Scott A. Rodibaugh; Delwin E. Cobb, both of Peoria, Ill.

[73] Assignee: Caterpillar Tractor Co., Peoria, Ill.

[21] Appl. No.: 251,526

[22] PCT Filed: Aug. 22, 1980

[86] PCT No.: PCT/US80/01087

§ 371 Date: Aug. 22, 1980

§ 102(e) Date: Aug. 22, 1980

[87] PCT Pub. No.: WO82/00689

PCT Pub. Date: Mar. 4, 1982

[51] Int. Cl.[3] ..... F01C 1/18; F01C 21/00; F04C 2/18; F04C 15/00

[52] U.S. Cl. ..... 418/76; 418/78; 418/80; 418/206

[58] Field of Search ..... 418/15, 75, 76, 78, 418/80, 180, 205, 206

[56] References Cited

U.S. PATENT DOCUMENTS

| | | | |
|---|---|---|---|
| 2,541,010 | 2/1951 | Ungar | 418/206 |
| 3,267,862 | 8/1966 | Mosbacher | 418/15 |
| 3,526,470 | 9/1970 | Swanson | 418/206 |
| 4,231,726 | 11/1980 | Cobb et al. | 418/75 |

*Primary Examiner*—John J. Vrablik

*Attorney, Agent, or Firm*—Charles E. Lanchantin, Jr.

[57] ABSTRACT

A gear pump (10) is disclosed having a housing (12) defining first and second gear cavities (38,40) and inlet and outlet ports (42,44). A pair of intermeshing gears (20,22) having a plurality of teeth (32) and teeth roots (36) are positioned in the cavities. A pair of bleed slots (50) are provided for directly communicating with the gear tooth roots and permitting entrained air and fluid thereat to be delivered away from the inlet and outlet ports. Advantageously, the bleed slots are located generally adjacent the breakaway points (46) of the respective cavities, and a pair of charging slots (62) are provided for communicating pressure from the outlet port with the gear teeth and encouraging movement of entrained air radially inwardly toward the bleed slots.

11 Claims, 2 Drawing Figures

GEAR PUMP HAVING FLUID DEAERATION CAPABILITY

TECHNICAL FIELD

The present invention relates to a gear pump, and more particularly to a gear pump having a pair of intermeshing gears in a housing and constructed for discharging a fluid with a reduced amount of entrained air therein.

BACKGROUND ART

When a positive displacement pump having a pair of intermeshing spur gears is used for scavenging purposes on a vehicle traversing uneven terrain there is often an excessive amount of entrained air present in the fluid discharged from the pump. This is understandable because the inlet tube to the pump can be out of full communication with the fluid in the auxiliary tank or reservoir so that air is ingested. Alternatively, the fluid that is in the auxiliary reservoir can contain an excessively high amount of entrained and dissolved air, in which case the pump simply passes the undesirably aerated fluid to the main supply tank of the parent supply system. Once the aerated fluid is in the parent supply system the operation of the associated controls and components can be adversely influenced. Hence there is a need for a scavenge or sump pump that can receive highly aerated fluid, that can separate a high portion of the air for return to the auxiliary tank, and that can subsequently route fluid with an acceptable level of entrained air to the main supply tank.

Furthermore, such an improved pump should be simple in construction for economic reasons, should be compact to make the best use of available space, and should be effective in operation.

Of general interest to these problems is U.S. Pat. No. 3,526,470 to V. E. Swanson on Sept. 1, 1970 which discloses a low speed pump for circulating a viscous liquid food product and permitting the escape of trapped gases from the product. Since in that pump construction gas can exit only in a very narrow angular region from the unfilled spaces in the rotor pockets, the pump would be relatively ineffective for handling oil. If oil was being pumped undesirable pressure and fluid losses would occur, and intermittent pressure surges would result at the discharge port. Moreover, there is no teaching or suggestion of utilizing centrifugal forces and/or fluid pressure forces to encourage air bubble migration radially inwardly for any substantial angular portion of the individual gear cavities.

More representative of the gear pump art is U.S. Pat. No. 2,541,010 to G. A. Ungar on Feb. 6, 1951. That patent shows a gear pump having cross connected pressure and suction balancing ports. However, it is not constructed for separating air bubbles from the oil, collecting the highly air entrained fluid, and then communicating that fluid outwardly of the pump and away from the inlet or outlet ports. It is merely typical of a large number of pumps that have pressure balancing ports or noise-reducing recesses which are not specifically tailored for deaeration purposes.

The present invention is directed to overcoming one or more of the problems as set forth above.

DISCLOSURE OF THE INVENTION

In one aspect of the present invention a gear pump is provided having a pair of intermeshing gears in a housing. Advantageously, separate bleed port means and charging passage means are defined in the housing. On the one-hand the bleed port means communicates entrained air collected in the fluid at the roots of the gear teeth as a result of centrifugal force away from the inlet and the outlet ports of the pump. And on the other hand the charging passage means communicates fluid under pressure at the outlet port of the pump with the teeth in order to encourage the movement of entrained air radially inwardly or centripetally toward the bleed port means.

More specifically, the gear pump housing of the present invention has defined therein a pair of arcuate bleed slots and a pair of arcuate charging slots which are so constructed and arranged as to achieve a substantial reduction in the amount of entrained air being delivered to the outlet port of the pump. For example, if the fluid intake to the pump would exhibit an entrained air level of about 20% by volume under substantially standard temperature and pressure conditions, the pump of the present invention can be expected to remove 45% or more of such entrained air in a single pass.

BEST MODE FOR CARRYING OUT THE INVENTION

Figure 1:
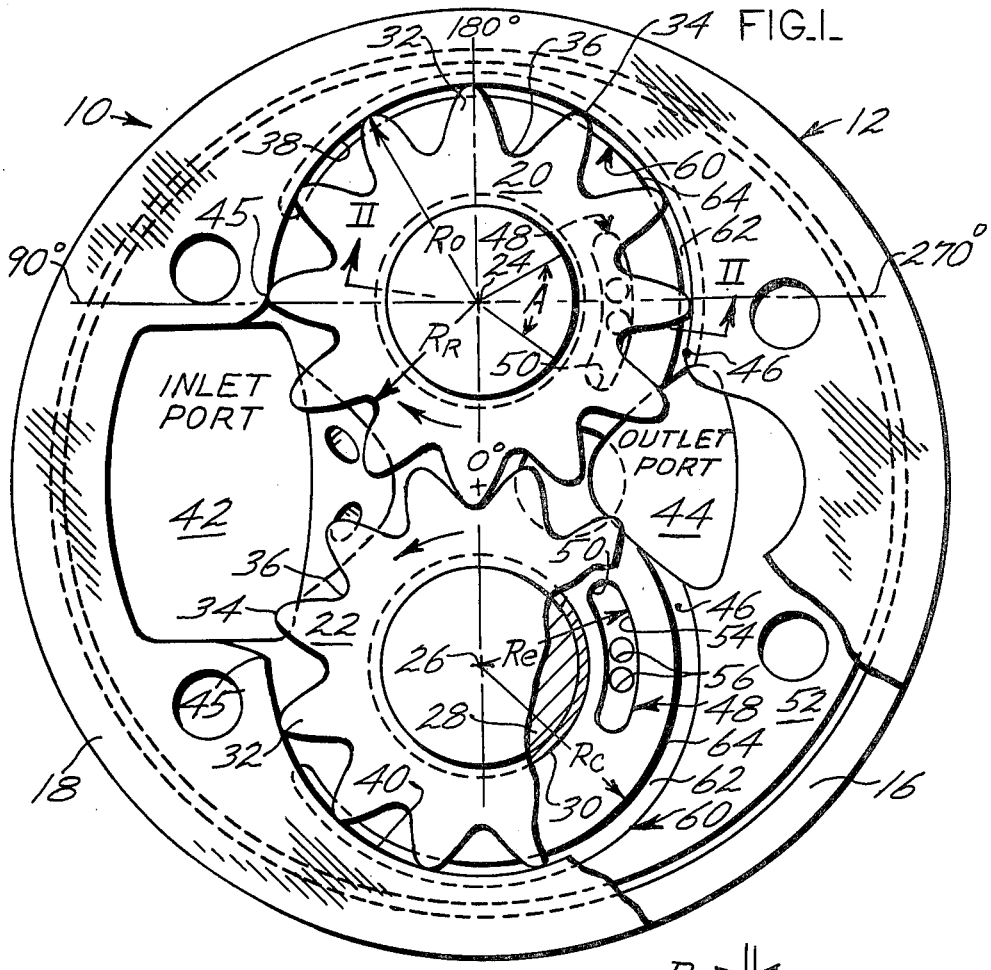
FIG. 1 is a diagrammatic plan view of the gear pump of the present invention with one end member removed and a portion of the central body and one gear broken open to better illustrate certain details thereof.

Referring to the drawings, a gear pump 10 is disclosed including a three-piece housing generally designated by the reference numeral 12 and having first and second end members or covers 14 and 16, and a central body 18 disposed between the end members. In FIG. 1 the first end member 14 has been removed in order to better see the construction details of the pump.

As best shown in FIG. 1, the gear pump 10 has a driving spur gear 20 in the upper part of that figure and a driven spur gear 22 in the lower part. The driving spur gear is powered for rotation in a clockwise direction about a first axis 24 by any conventional means, and the driven gear is in intermeshing engagement therewith and thus is rotated in a counterclockwise direction about a second axis 26. Each of the gears preferably has an integral shaft 28 which is received in a cylindrical bushing 30 in the usual manner.

Each of the spur gears 20 and 22 has a plurality of gear teeth 32 defining a corresponding plurality of alternating teeth tips 34 and teeth roots 36. As is representatively illustrated in FIG. 1 the distance between the respective axis 24,26 and one of the teeth tips is designated as radius $R_o$, and the distance between the respective axis and one of the teeth roots is designated as radius $R_R$.

The central body 18 of the gear pump 10 has first and second intersecting cavities 38,40 defined therein for relatively closely receiving the driving and driven gears 20,22 respectively. Thus it is apparent that the gears intermesh at a zero degree position located on a plane through the axes 24 and 26, and the teeth 32 move to the left when viewing the drawing therefrom to separate and provide a region of suction or vacuum at an inlet port 42 defined in the housing 12, or more particularly the end member 16 which serves as a manifold. At the right side thereof the teeth come together and provide a region of increased pressure at an outlet port 44 defined in the end member 16.

In the instant example the gear teeth 32 of the gears 20,22 rotate approximately 90° from the zero position prior to mating with the walls of the respective cavities 38,40 at the entry points designated by the reference number 45 in FIG. 1. Moreover, each gear tooth exits from the walls of the respective cavities and thereby provides an increase in the outside diameter tooth clearance beyond the established minimum thereat at about the 290° position of tooth rotation as indicated by the breakaway points identified by the reference number 46 in FIG. 1.

Figure 2:
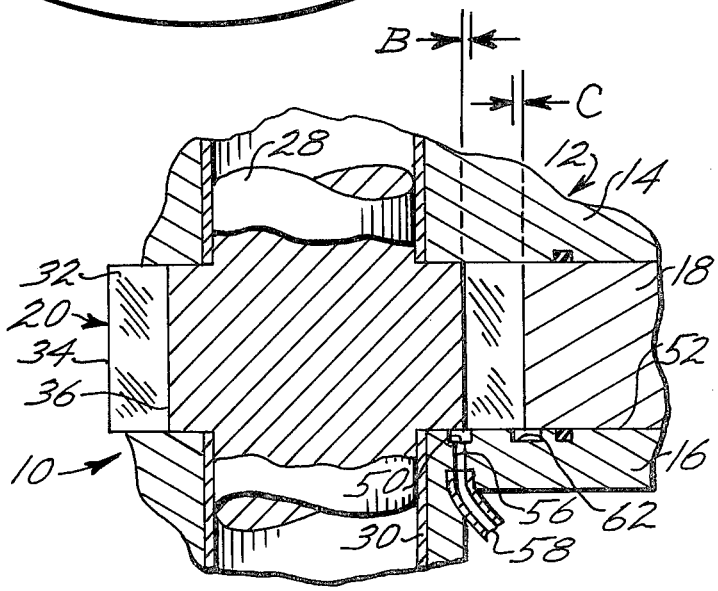
FIG. 2 is a diagrammatic, fragmentary sectional view of the gear pump of the present invention as taken along line II—II of FIG. 1.

In carrying out the present invention, bleed port means 48 are defined in the housing 12 for communicating entrained air collected in the fluid at the gear teeth roots 36 away from the gear pump 12 and particularly the inlet and outlet ports 42,44. Preferably, such bleed port means includes a pair of arcuately shaped bleed slots 50 formed in the inner wall surface 52 of either the first or second end member 14,16 and extending through a preselected angular region "A" of each of the cavities 38,40 as is representatively shown in FIG. 1. In the illustrated embodiment each preselected angular region "A" is about 50° in overall extent and is radially aligned generally with the respective breakaway point 46. Each slot extends from about 250° to about 300° and defines an outer edge 54 with the inner wall surface 52 which has a preselected radius $R_e$. The radius $R_e$ is greater than the radius $R_R$ of the teeth roots 36 to provide a preselected degree of slot overlap as is indicated in FIG. 2 by the letter "B". In the instant embodiment the slot overlap "B" is about 1.66 mm (0.065"), or about 15% of the overall radial height of the gear teeth 32 ($R_o$–$R_R$). One or more cylindrical relief passages 56 in the end member communicates with the bottom of each of the bleed slots and are in communication with one or more conduits 58 as shown in FIG. 2 to direct the highly aerated portion of the pump fluid back to the reservoir at a location spaced away from the usual intake conduit leading to the inlet port 42.

Charging passage means 60 are also advantageously defined in the housing 12 for communicating fluid under pressure at the outlet port 44 with the gear teeth 32 and encouraging the movement of entrained air radially inwardly toward the teeth roots 36 and the bleed port means 48. Specifically, such charging passage means preferably includes a pair of charging slots 62 in the inner wall surface 52 of either the first or second end member 14,16, with these slots being located radially outwardly of the preselected angular regions "A". Preferably, the charging slots 62 extend around the periphery of the gears 20,22 from a direct communication with the outlet port 44 back through the 180° relative to the zero degree position of intermeshing contact of the gears. In the instant example the charging slots extend from the point of communication with the outlet port 44 arcuately about 180° toward the inlet port 42, or to about the 115° point. Also, each of the charging slots defines an inner edge 64 with the inner wall surface 52 which has a preselected radius $R_C$ as is illustrated in FIG. 1. Such radius is less than the radius $R_o$ of the teeth tips 34 to provide a preselected degree of tooth overlap as is indicated in FIG. 2 by the letter "C". In the example the tooth overlap "C" is about 2.67 mm (0.105"), or about 25% of the overall radial height of the gear teeth 32.

The bleed slots 50 are preferably straight-sided and about 1.5 mm (0.060") deep and 6.3 mm (0.250") wide to assure the correct flow rate of the aerated fluid. Similarly, the charging slots 62 are preferably straight-sided and about 1.5 mm (0.060") deep and 5.3 mm (0.210") wide to assure the desired amount of pressurized fluid throughout the angular working region.

INDUSTRIAL APPLICABILITY

The gear pump 10 is particularly useful for reducing the transfer of air from a remotely disposed sump or auxiliary reservoir back to the main reservoir. Air entrainment in oil can be a very frustrating problem since it can reduce the hydraulic efficiency and responsiveness of the associated hydraulic control system. For example, because of limited space availability many auxiliary oil reservoirs have a lower than desired capacity, and to insure that they do not overfill during use the oil is scavenged therefrom at a rate higher than the flow into them. Thus a portion of the time can be spent scavenging air. Therefore it is desirable to separate the entrained air from the oil on a continuous basis.

In operation, twelve tooth driving and driven gears 20,22 were rotated at about 1800 rpm and oil was ingested with about 20% entrained air by volume at the inlet port 42. As the relatively foamy oil was urged by the gear teeth 32 in the clockwise and counterclockwise directions by the respective gears, centrifugal force acted as a separator to force the heavier oil to the outside and the lighter air toward the teeth roots 36. Since the charging slots 62 supplied fluid under pressure to the periphery of the teeth, the air bubbles tended to be compressed and were further encouraged to move radially inwardly or centripetally from about the 115° point onward.

At about the 250° point the teeth roots 36 overlapped the bleed slots 50, and an appreciable portion of the air and some fluid was communicated from the bleed slots, the relief pressure 56 and the conduits 58 back to the auxiliary sump. The remainder of the fluid with significantly reduced air content was directed to the outlet port 44 at a pressure of about 700 kPa (100 psi). It was found that the addition of two bleed slots 50 and two charging slots 62 in the end member 16 as shown in FIG. 1 reduced the flow rate of the gear pump 10 about 10% over a standard pump without such slots. However, it was concluded that the gear pump 10 removes at least about 45% of the entrained air and does this effectively over a wide speed range in a single pass. In the example just described the opposite end member 14 did not have any slots 50 or 62 formed therein. Even though the performance of the gear pump 10 deteriorated somewhat when both end members 14 and 16 had such slots in a substantially mirror image manner, we contemplate that four bleed slots 50 and four charging slots 62 can still be very desirable, and may be preferred in some applications.

The optimum angular locations of the bleed slots 50 and the charging slots 62 are basically functions of the pressure gradient, which gradient varies with gear speed, pressure drop, gear teeth tip clearance and the pitch of the gear teeth. Because there is typically about a 30° angular transition zone just prior to or near about the 180° point, for example, where static pressure changes from negative to positive, it is preferred that the bleed slots 50 not extend back to such zone to prevent any backflow of entrained air.

Thus it is apparent that the low pressure gear pump 10 has a very desirable deaeration capability at but a minimal loss in flow rate. It is simple and economical in construction, and yet can greatly enhance the operation of the hydraulic control system with which it is associated.

Other aspects, objects and advantages of this invention can be obtained from a study of the drawings, the disclosure and the appended claims.

What is claimed is:

1. In a gear pump (10) having a housing (12) defining first and second intersecting cavities (38,40) and inlet and outlet ports (42,44), first and second intermeshing gears (20,22) having a plurality of teeth (32) and a plurality of teeth roots (36), each gear (20,22) being positioned respectively in one of the first and second cavities (38,40), the improvement comprising:

bleed port means (48) for communicating entrained air collected in the fluid at said gear teeth roots (36) as a result of centrifugual force away from said inlet and outlet ports (42,44), said bleed port means (48) including a bleed slot (50) defined in said housing (12) and communicating directly with said gear teeth roots (36) in a preselected angular region of each of said cavities (38,40); and charging passage means (60) for communicating fluid under pressure at said outlet port (44) with said teeth (32) and encouraging the movement of entrained air radially inwardly toward said bleed slots (50), said charging passage means (60) including a charging slot (62) defined in said housing (12) and being located radially outwardly of each of said bleed slots (50), said charging slots (62) extending peripherally from said outlet port (44) back through the 180° point relative to a zero degree position of intermeshing contact of said gears (20,22).

2. The gear pump (10) of claim 1 wherein each of said bleed slots (50) extends through a preselected angular region of about 50°.

3. The gear pump (10) of claim 1 wherein said charging slots (62) extend arcuately from about 115° to about 290° relative to a zero degree position of intermeshing contact of said gears (20,22).

4. The gear pump (10) of claim 1 wherein said charging slots (62) are connected to said outlet port (44) and extend through an angular region of about 180°.

5. The gear pump (10) of claim 1 wherein said housing (12) includes first and second end members (14,16) and a body (18) disposed therebetween, said charging slots (62) being defined in one of said end members (14,16).

6. The gear pump (10) of claim 5 wherein said charging slots (62) extend peripherally back to about the 115° point.

7. The gear pump (10) of claim 5 wherein said bleed slots (50) are defined in one of said end members (14,16).

8. The gear pump (10) of claim 1 wherein said bleed slots (50) extend arcuately from about 250° to about 300° relative to a zero degree position of intermeshing contact of said gears (20,22).

9. The gear pump (10) of claim 8 wherein said charging slots (62) extend arcuately from about 115° to about 290° relative to a zero degree position of intermeshing contact of said gears.

10. The gear pump (10) of claim 1 wherein each of said bleed slots (50) has an outer edge 54 radially overlapping said teeth roots (36) by a preselected radial distance B.

11. The gear pump (10) of claim 10 wherein each of said charging slots (62) has an inner edge (64) and said teeth (32) define a plurality of teeth tips (34) which radially overlap said charging slots (62) by a preselected radial distance C.

* * * * *